US011603635B2

(12) United States Patent
Lim

(10) Patent No.: US 11,603,635 B2
(45) Date of Patent: Mar. 14, 2023

(54) CRASH CUSHION WITH IMPROVED REINFORCING CABLE SYSTEM

(71) Applicant: Lindsay Transportation Solutions, LLC, Omaha, NE (US)

(72) Inventor: Jason Lim, Rio Vista, CA (US)

(73) Assignee: Lindsay Transportation Solutions, LLC, Omaha, NE (US)

( * ) Notice: Subject to any disclaimer, the term of this patent is extended or adjusted under 35 U.S.C. 154(b) by 295 days.

(21) Appl. No.: 16/849,174

(22) Filed: Apr. 15, 2020

(65) Prior Publication Data

US 2021/0324592 A1 Oct. 21, 2021

(51) Int. Cl.
*E01F 15/14* (2006.01)

(52) U.S. Cl.
CPC ..... *E01F 15/146* (2013.01)

(58) Field of Classification Search
CPC ..... E01F 15/025; E01F 15/146; E01F 15/06; E01F 15/065; E01F 15/08; E01F 15/086
See application file for complete search history.

(56) References Cited

U.S. PATENT DOCUMENTS 3,674,115 A * 7/1972 Young ..... E01F 15/146 267/116
4,452,431 A * 6/1984 Stephens ..... E01F 15/146 404/6
4,583,716 A * 4/1986 Stephens ..... E01F 15/146 248/499
4,815,565 A * 3/1989 Sicking ..... E01F 15/146 404/6
5,851,005 A * 12/1998 Muller ..... E01F 15/146 404/6
6,536,986 B1 * 3/2003 Anghileri ..... E01F 15/146 404/6
6,811,144 B2 * 11/2004 Denman ..... E01F 15/146 404/6
6,905,281 B2 * 6/2005 Kang ..... E01F 15/146 404/9
7,168,880 B2 * 1/2007 Kennedy, Jr. ..... E01F 15/146 404/9
8,016,513 B2 * 9/2011 Shin ..... E01F 15/146 404/6
8,491,216 B2 * 7/2013 Dyke ..... E01F 15/146 404/6
8,974,142 B2 * 3/2015 Buehler ..... E01F 15/088 404/6
9,051,698 B1 * 6/2015 Anghileri ..... E01F 15/146
10,006,179 B2 * 6/2018 Buehler ..... E01F 15/086
11,268,250 B2 * 3/2022 Lim ..... E01F 15/146
2003/0168650 A1 * 9/2003 Alberson ..... E01F 15/146 256/13.1
2008/0181722 A1 * 7/2008 McKenney ..... E01F 15/0453 404/6

(Continued)

*Primary Examiner* — Daniel J Wiley
(74) *Attorney, Agent, or Firm* — Hovey Williams LLP

(57) ABSTRACT

A crash cushion includes a number of spaced-apart supports or bulkheads; energy absorbing modules positioned between the supports; overlapping side panels that interconnect the supports and envelop the energy absorbing modules; front and rear fixed anchors; and reinforcing cables extending between the anchors. The cables extend through cable guides formed in the supports so as to stabilize the supports and facilitate controlled collapse of the supports during vehicle impacts.

20 Claims, 8 Drawing Sheets

(56) References Cited

U.S. PATENT DOCUMENTS

2012/0121325 A1* 5/2012 Buehler ..... E01F 15/088
404/6
2021/0108383 A1* 4/2021 Maus ..... E01F 15/0423

* cited by examiner

CRASH CUSHION WITH IMPROVED REINFORCING CABLE SYSTEM

BACKGROUND

Vehicle impact absorbing systems, also called "crash cushions," are often installed adjacent rigid structures such as pillars, bridge abutments, lighting poles and the like for absorbing vehicle impact energy and minimizing the effects of impact on a vehicle, the vehicle's occupants, and the structure being protected.

One type of crash cushion includes a number of spaced-apart supports or bulkheads; energy absorbing modules positioned between the supports; overlapping side panels that interconnect the supports and envelop the energy absorbing modules; and reinforcing cables that are clamped below the supports/bulkheads. This type of crash cushion is designed to collapse upon itself in an accordion or telescoping fashion when subjected to a frontal vehicle impact so as to transfer and absorb vehicle impact energy over a predetermined distance. When subjected to a side vehicle impact, the crash cushion is configured to redirect the vehicle away from the crash cushion and the rigid structure being protected by the crash cushion.

Unfortunately, the reinforcing cables of some prior art crash cushions inhibit controlled collapse of the crash cushions during frontal impacts.

SUMMARY

The present invention solves the above-described problems and other related problems by providing a crash cushion with an improved reinforcing cable system.

A crash cushion constructed in accordance with an embodiment of the invention broadly comprises a number of spaced-apart supports or bulkheads; energy absorbing modules positioned between the supports; overlapping side panels that interconnect the supports and envelop the energy absorbing modules; front and rear fixed anchors; and reinforcing cables extending between the anchors.

Rather than being clamped below the supports, the cables extend through cable guides integrally formed in the supports so as to stabilize the supports and facilitate controlled collapse of the supports during vehicle impacts. In one embodiment, each support includes a central frame, a ground engaging component below the frame, and four strategically positioned cable guides, including a lower left side cable guide, an upper left side cable guide, a lower right side cable guide, and an upper right side cable guide. The lower cable guides are preferably positioned at least 10" above the lowest portion of the ground engaging component, and the upper cable guides are preferably positioned at least 20" above the lowest portion of the ground engaging component.

One embodiment of the crash cushion comprises four reinforcing cables, with a pair of cables on each side of the crash cushion: a lower left side cable, a lower right side cable, an upper left side cable, and an upper right side cable.

The lower left side cable is affixed to the front anchor structure and the rear anchor structure and extends through the lower left side cable guides in the supports so that a substantial length of the cable is at least 10" above a ground surface on which the crash cushion is installed. Likewise, the lower right side cable is also affixed to the front anchor structure and the rear anchor structure and extends through the lower right side cable guides so that a substantial length of the cable is also at least 10" above the ground surface.

The upper left side cable is affixed to the front anchor structure and the rear anchor structure and extends through the upper left side cable guides in the supports so that a substantial length of the cable is at least 20" above the ground surface. Likewise, the upper right side cable is affixed to the front anchor structure and the rear anchor structure and extends through the upper right side cable guides so that a substantial length of the cable is at least 20" above the ground surface.

Applicant has discovered that employing two spaced reinforcing cables on each side of the crash cushion, and elevating the cables so that the lower cables are at least 10" above the ground and the upper cables are at least 20" above the ground, helps redirect vehicles away from the crash cushion during side vehicular impacts and greatly reduces the likelihood of vehicle roll-overs.

In accordance with another important aspect of the invention, each cable guide comprises a hollow tubular member that defines a horizontally extending passageway. Each passageway has an internal diameter greater than an external diameter of the cables so that the reinforcing cables pass through the passageways but are not clamped to or otherwise affixed to the cable guides. The cable guides and cables therefore reinforce and help stabilize the supports but do not inhibit controlled collapse of the supports during frontal vehicle impacts.

This summary is provided to introduce a selection of concepts in a simplified form that are further described in the detailed description below. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Embodiments of the present invention are described in detail below with reference to the attached drawing figures, wherein.

Figure 1:
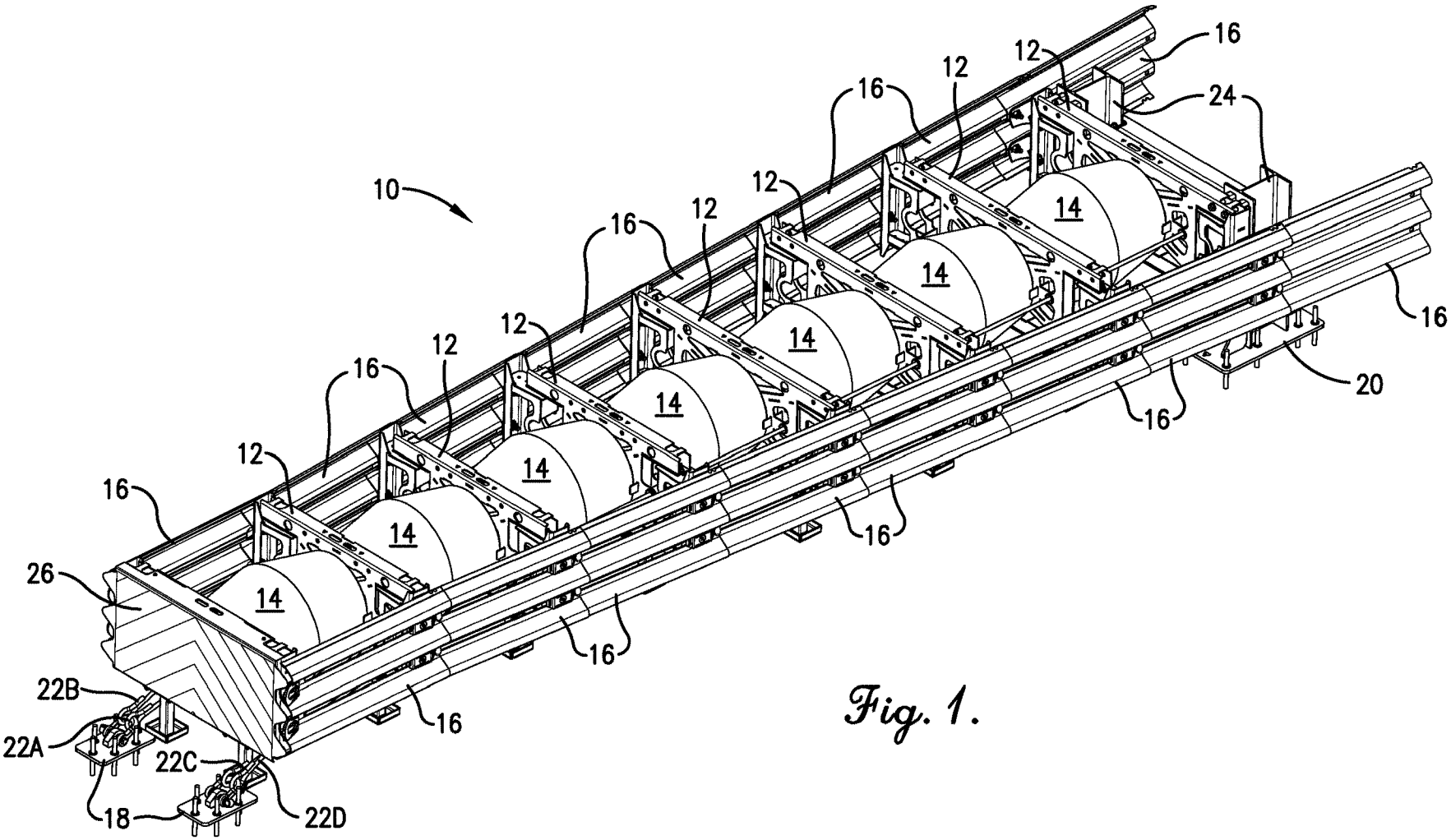
FIG. 1 is a top perspective view of a crash cushion constructed in accordance with embodiments of the invention.

The drawing figures do not limit the present invention to the specific embodiments disclosed and described herein.

The drawings are not necessarily to scale, emphasis instead being placed upon clearly illustrating the principles of the invention.

DETAILED DESCRIPTION

Turning now to the drawing figures, a crash cushion 10 constructed in accordance with embodiments of the invention is illustrated. The crash cushion 10 may be installed adjacent a rigid structure such as a pillar, bridge abutment, lighting pole, or the like for absorbing vehicle impact energy and minimizing the effects of impact on a vehicle, the vehicle's occupants and the structure being protected.

As best shown in FIG. 1, an embodiment of the crash cushion 10 broadly comprises a number of spaced-apart supports 12; energy absorbing modules 14 positioned between the supports 12; overlapping side panels 16 that interconnect the supports 12 and envelop the energy absorbing modules 14; a front anchor structure 18; a rear anchor structure 20; and reinforcing cables 22A, 22B, 22C, 22D extending between the anchors 18, 20. The crash cushion 10 also includes a substantially immovable support frame 24 fixedly anchored to the rear anchor structure 20 in a rearmost position relative to the supports 12 and a front impact member or nose 26 located at the forward end of the crash cushion 10. Embodiments of each of these components will now be described in more detail.

The supports 12 are spaced along a longitudinal axis of the crash cushion 10 and, except for the support closest to the immoveable support frame 24, are configured to telescopically slide and collapse toward the immovable support frame 24 when the front of the crash cushion is struck by a vehicle. The supports 12 also cooperate with other components of the crash cushion to redirect a vehicle away from the crash cushion and the structure being protected when either side of the crash cushion is struck by a vehicle.

Figure 9:
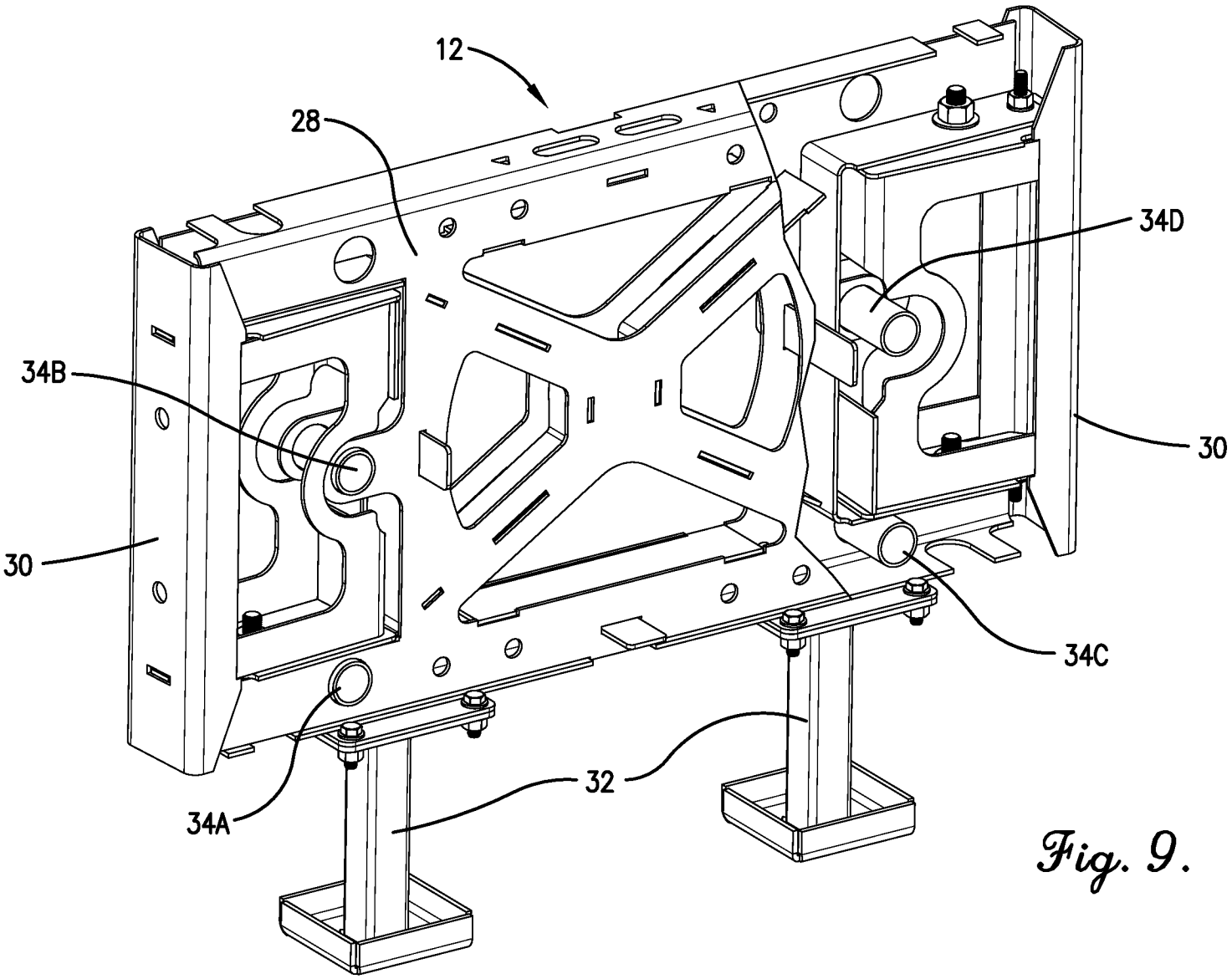
FIG. 9 is a perspective view of one of the supports of the crash cushion with portions removed to illustrate internal features of the support.

As best shown in FIG. 9, each support 12 includes a central frame 28, two hinge assemblies 30, one on each side of the central frame, a ground engaging component 32, and cable guide structures 34A, 34B, 34C, 34D integrated in the central frame 28.

The central frame 28 may be formed of metal or other suitable materials and stands upright about a generally vertical axis. In one embodiment, the central frame 28 is rectangular, but it may be formed in any shaped.

The hinge assemblies 30 are attached to opposite sides of the central frame 28 and provide pivoting attachment points for the side panels. The hinge assemblies can be mounted in several different positions with respect to the central frame.

The ground engaging component 32 depends from the central frame 28 and supports the frame above a ground surface such as a road, sidewalk, or area near a pillar, bridge, etc. In one embodiment, the ground engaging component includes a pair of posts, each with a ground-contacting lower foot.

The integrated cable guides 34A, 34B, 34C, 34D guide the cables 22A, 22B, 22C, 22D between the anchors 18, 20 and allow relative slidable movement between the cables 22 and the supports 12 upon collapse of the crash cushion. In one embodiment, each support includes four cable guides: a lower left side cable guide 34A, an upper left side cable guide 34B, a lower right side cable guide 34C, and an upper right side cable guide 34D.

The lower left side and lower right side cable guides 34A, 34C are preferably positioned at least 10" above the lowermost portion of the ground engaging component, and the upper left side and upper right side cable guides 34B, 34D are preferably positioned at least 20" above the lowermost portion of the ground engaging component. In one particular embodiment, the lower left side and lower right side cable guides 34A, 34C are positioned 12.5" above the lowermost portion of the ground engaging component, and the upper left side and upper right side cable guides 34B, 34D are positioned 22" above the lowermost portion of the ground engaging component.

Each cable guide 34A, 34B, 34C, 34D comprises a hollow tubular member that defines an interior horizontally extending passageway. Each passageway has an internal diameter greater than an external diameter of the cables 22 A, 22B, 22C, 22D so that the cables pass through the passageways but are not clamped to or otherwise affixed to the cable guides. In one embodiment, the cables 22A, 22B, 22C, 22D each have an external diameter of ¾" and the passageways in the cable guides 34A, 34B, 34C, 34D each have an inside diameter of at least 1".

The energy absorbing modules 14 are disposed between and supported by the supports 12 and the immovable support frame 24. In the illustrated embodiment, the modules 14 are aligned between the supports 12 along the longitudinal axis of the crash cushion, but they may be staggered or positioned anywhere between the supports. Any number of supports 12 and energy absorbing modules 14 may be provided to form a crash cushion of any desired length and crash rating.

In one embodiment, the energy absorbing modules 14 are formed of molded plastic or other similar materials and are filled with foam, water, or other liquid and/or gaseous materials. Some of the modules 14 may include elongated narrow openings or slots formed therein that define deformable side wall strips which bend responsive to application of opposed forces such as might be caused by a vehicle impacting the crash cushion 10. Similarly, some of the modules may include holes, which encourages creation of folds in the modules when subjected to vehicle impacts.

Figure 3:
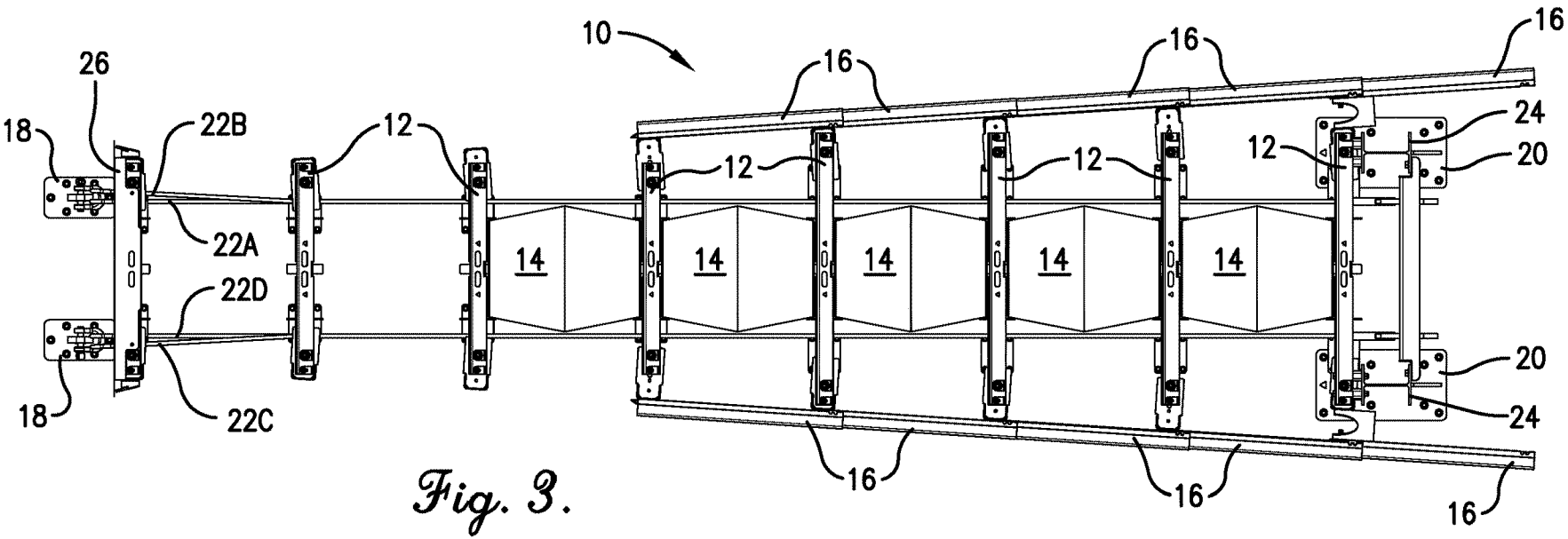
FIG. 3 is a plan view of the crash cushion with some of its components removed.
Figure 4:
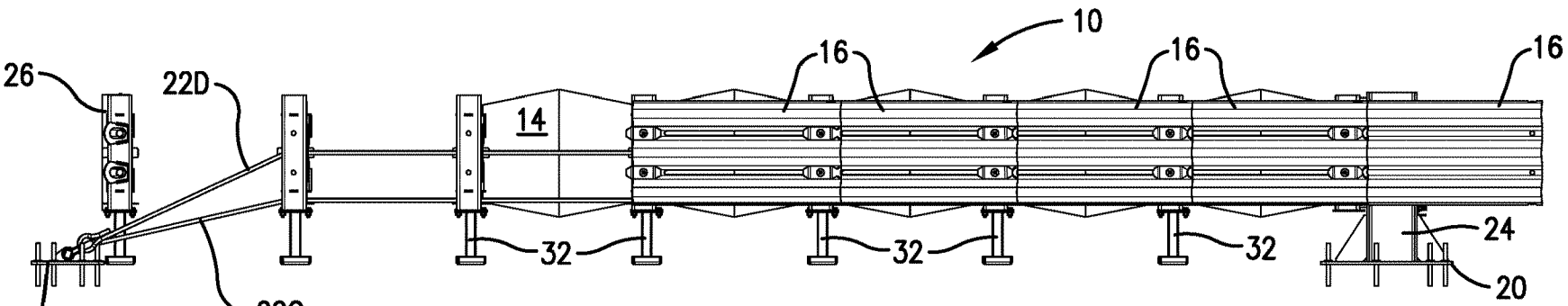
FIG. 4 is a side view of the crash cushion with some of its components removed.
Figure 5:
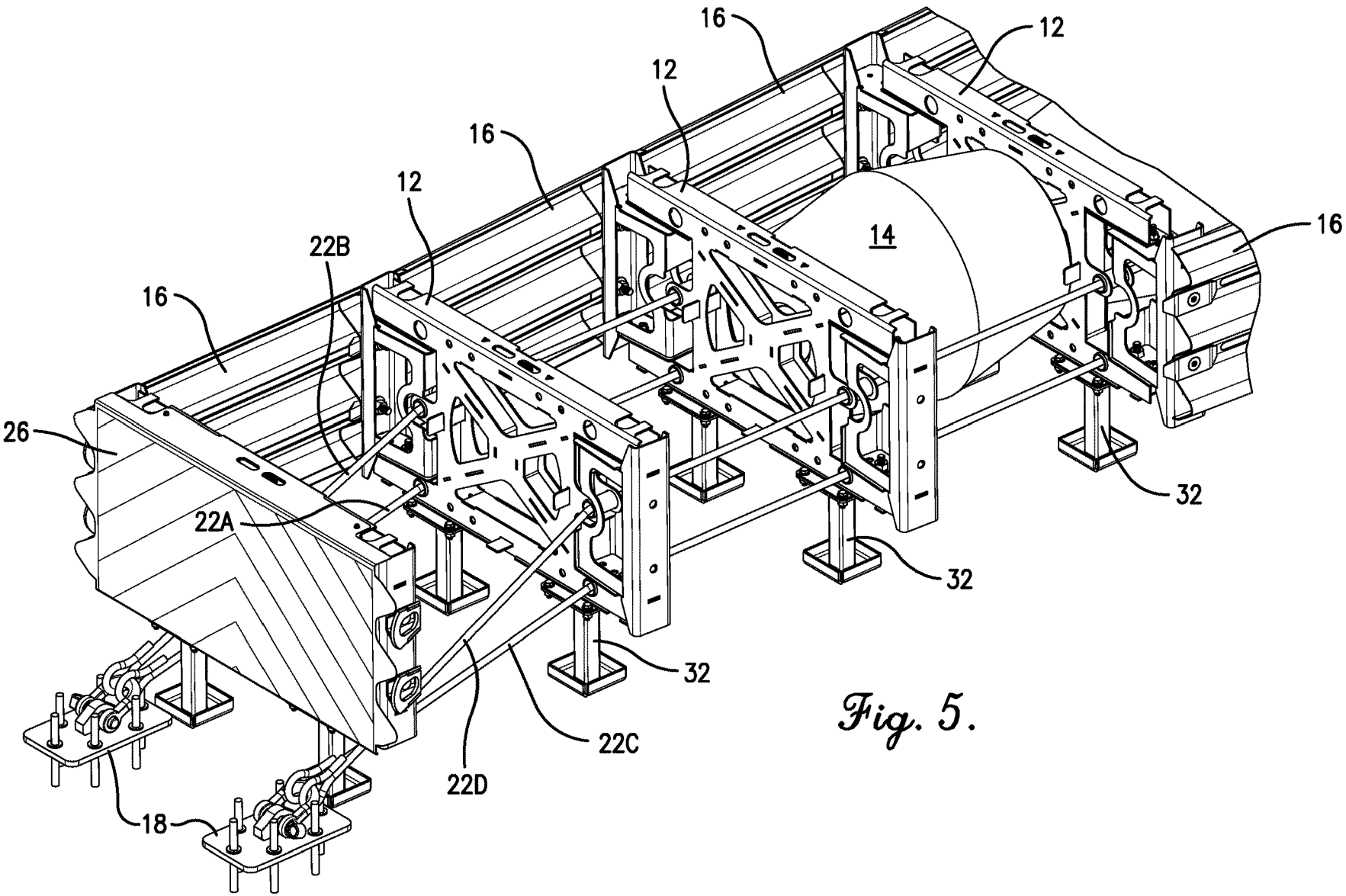
FIG. 5 is a partial top perspective view of a front portion of the crash cushion with some of its components removed.
Figure 6:
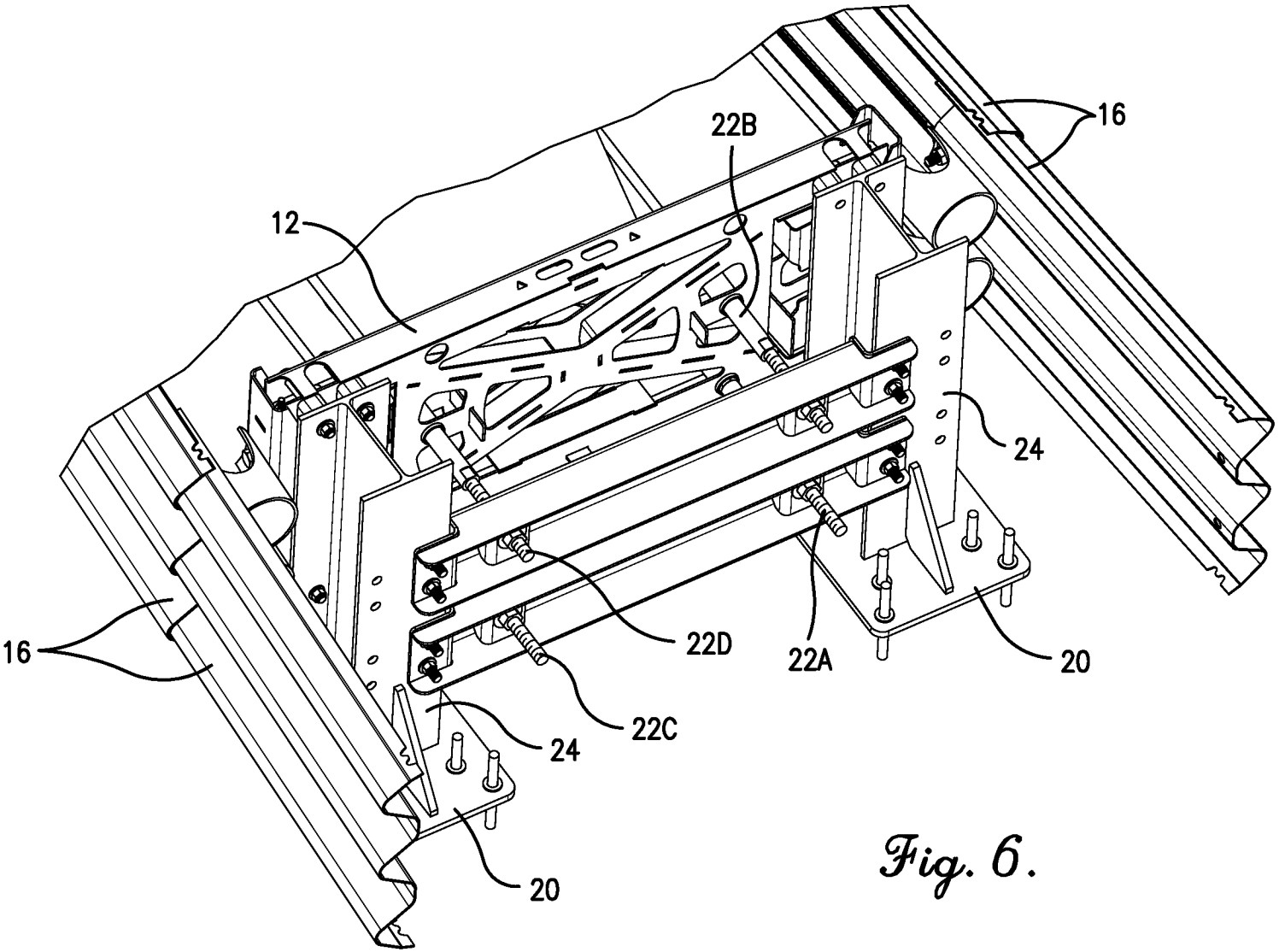
FIG. 6 is a partial top perspective view of a rear portion of the crash cushion with some of its components removed.

The side panels 16 interconnect the supports 12 and envelop the energy absorbing modules 14. As best shown in FIGS. 3 and 6, the side panels 16 are arranged in an overlapping and telescoping fashion, with the rear edge of each side panel overlapping the front edge of the side panel behind it when viewed from the front of the crash cushion.

The front anchor structure 18 and rear anchor structure 20 are fixed in position and essentially immovable. The anchor structures 18, 20 may include and/or be bolted to blocks of concrete embedded in the ground. The immoveable support 24 is bolted to, integrally formed with, or otherwise fixedly secured to the rear anchor structure 20.

The reinforcing cables 22A, 22B, 22C, 22D extend between the front and rear anchor structures 18, 22 and through the cable guides 34A, 34B, 34C, 34D formed in the supports. The cables 22A, 22B, 22C, 22D, anchor structures 18, 20, and cable guides 34A, 34B, 34C, 34D help maintain the initial, upright, non-crash position of the supports 12 and keep them from rotating about their vertical axes or falling down when moving rearward responsive to a frontal impact on the crash cushion or moving sideways responsive to a side impact so as to facilitate controlled collapse of the supports and/or redirection of a vehicle during vehicle impacts.

Figure 2:
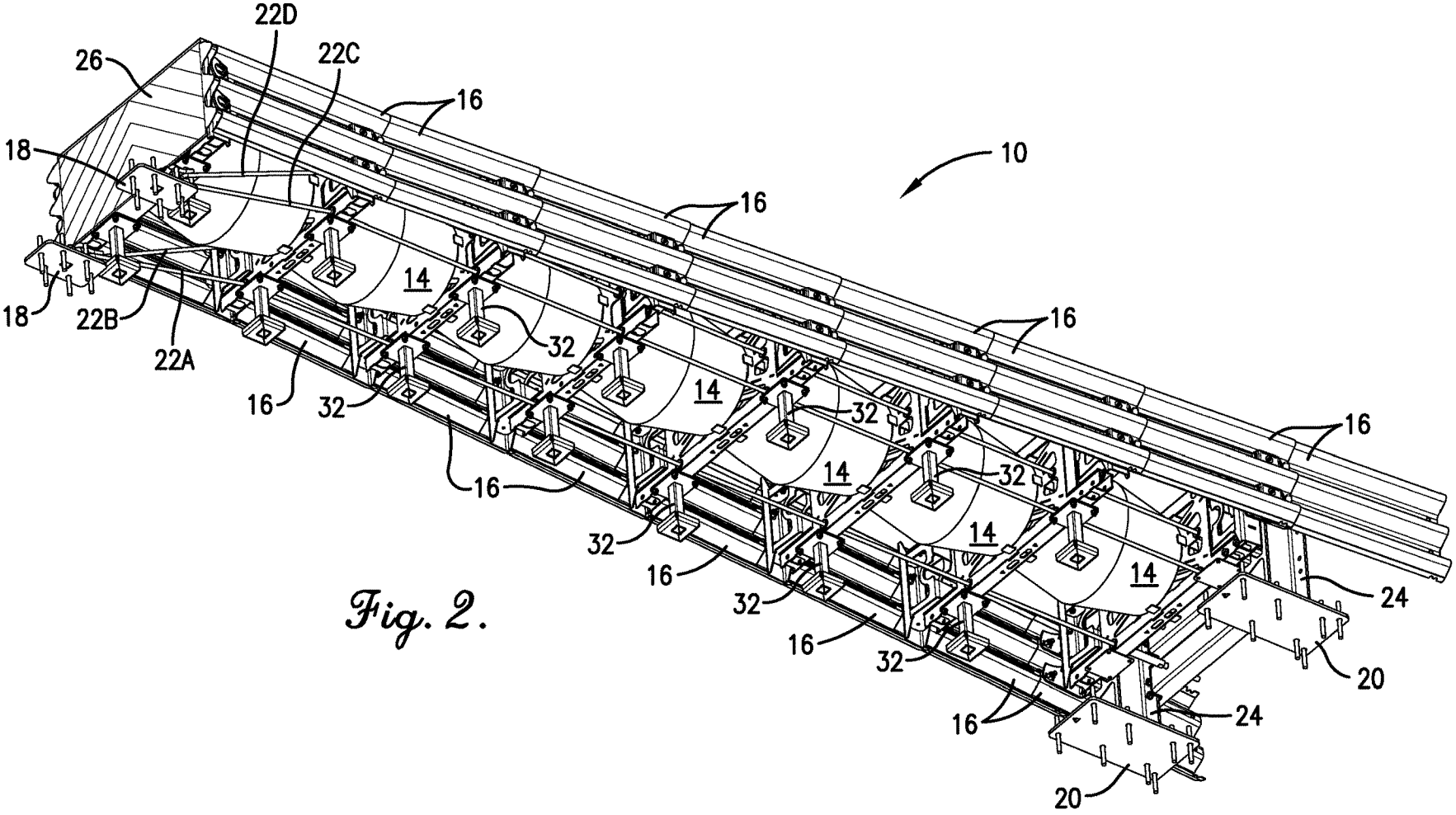
FIG. 2 is a bottom perspective view of the crash cushion.

An embodiment of the crash cushion comprises 4 separate reinforcing cables, with a pair of cables on each side of the crash cushion. As best shown in FIGS. 2, 3, and 6, the crash cushion includes a lower left side cable 22A, an upper left side cable 22B, a lower right side cable 22C, and an upper right side cable 22D.

The lower left side cable 22A is affixed to the front anchor structure 18 and the rear anchor structure 20 and extends through the lower left side cable guides 34A in the supports 12 so that a substantial length of the cable is at least 10" above a ground surface on which the crash cushion is installed. Likewise, the lower right side cable 22C is also affixed to the front anchor structure 18 and the rear anchor structure 20 and extends through the lower right side cable guides 34C so that a substantial length of the cable 22C is also at least 10" above the ground surface. In one embodiment, the lower cable guides 34A, 34C support the cables 22A, 22C 12½" above the ground.

The upper left side cable 22B is affixed to the front anchor structure 18 and the rear anchor structure 20 and extends through the upper left side cable guides 34B in the supports so that a substantial length of the cable 22B is at least 20" above the ground surface. Likewise, the upper right side cable 22D is affixed to the front anchor structure 18 and the rear anchor structure 20 and extends through the upper right side cable guides 34D so that a substantial length of the cable 22D is at least 20" above the ground surface. In one embodiment, the upper cable guides 34B, 34D support the cables 22B, 22D 12½" above the ground.

Figure 7:
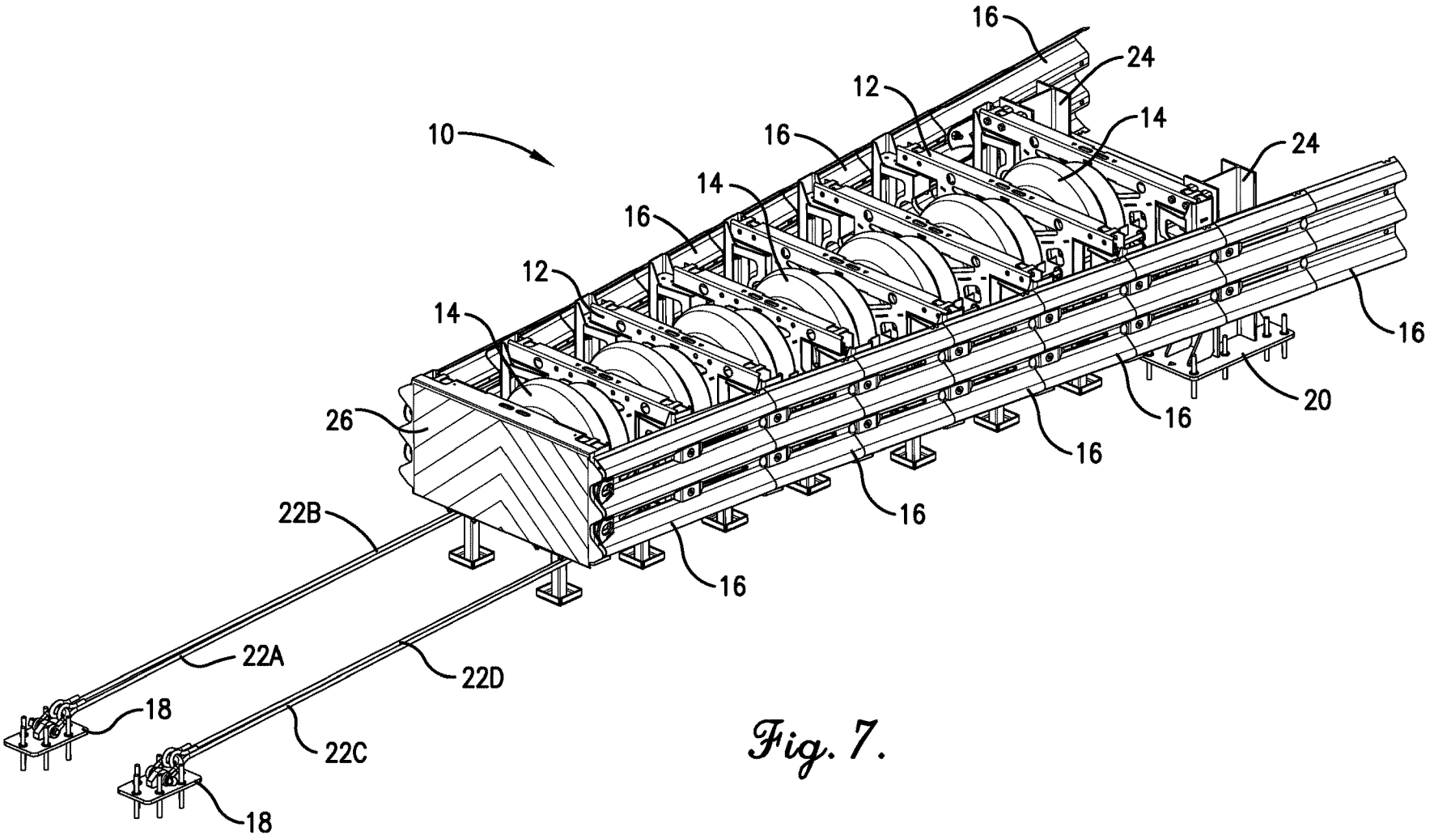
FIG. 7 is a top perspective view of the crash cushion in a collapsed state.
Figure 8:
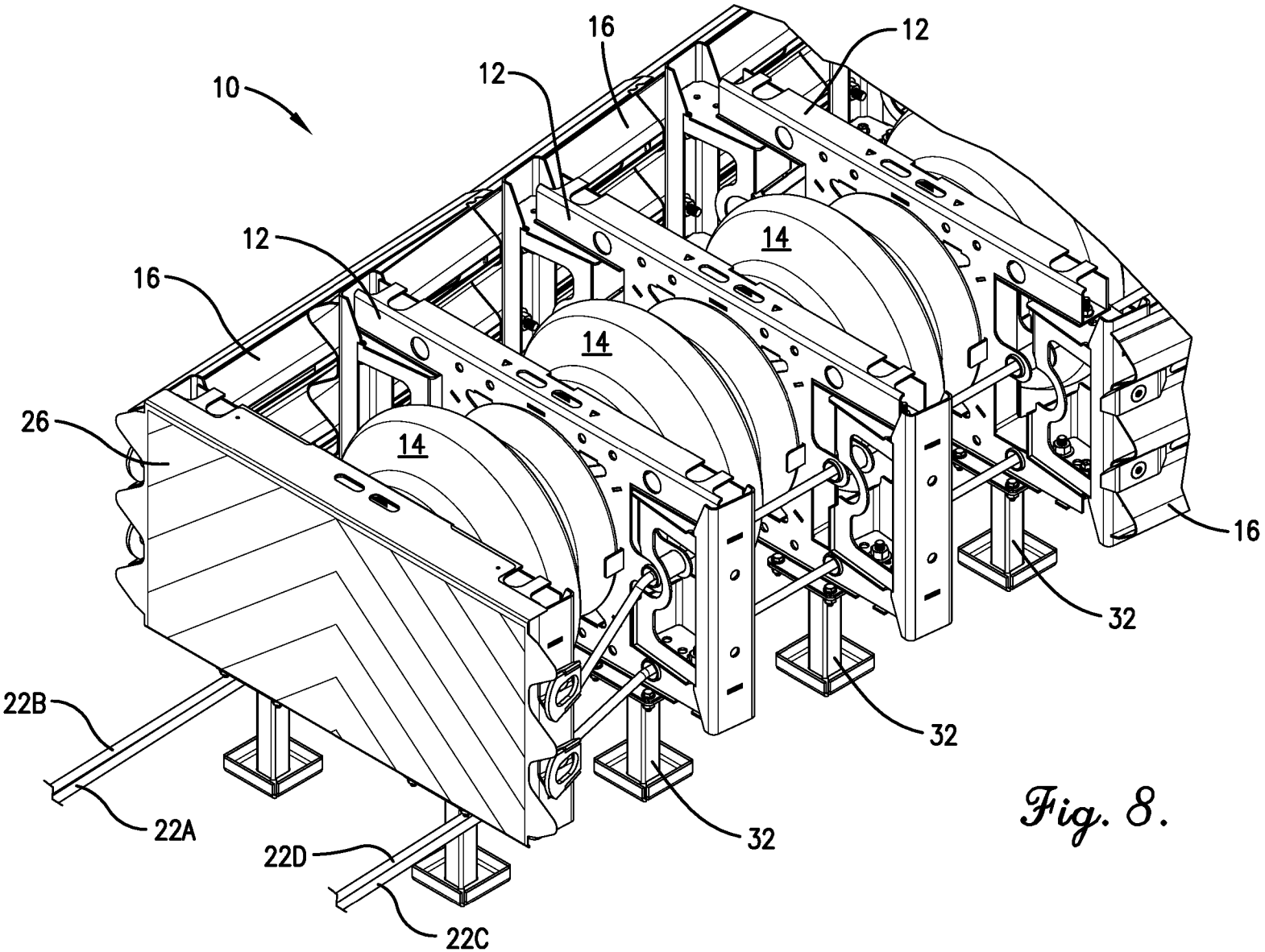
FIG. 8 is a partial top perspective view of the crash cushion in its collapsed state with some of its components removed.

FIGS. 7 and 8 illustrate the crash cushion 10 in a collapsed state after experiencing a frontal impact force, as for example caused by vehicle impact. As shown, the nose 26, supports 12, and side panels 16 telescopically collapse toward the immovable support frame 24, and each of the modules 14 collapses upon itself. The first module to collapse will be the forward most module. The modules disposed behind the front or forward most module will collapse in a generally accordion fashion, providing significantly greater resistance to the impact. As the supports 12 shift rearwardly toward the immovable support frame 24, they slide relative to, and are supported by, the reinforcing cables 22A, 22B, 22C, 22D.

By installing two spaced reinforcing cables on each side of the crash cushion 10, and elevating the cables so the lower cables 22A, 22C are at least 10" above the ground and the upper cables 22B, 22D are at least 20" above the ground, the cables help redirect vehicles away from the crash cushion during side vehicular impacts and greatly reduce the likelihood of vehicle roll-overs. A typical vehicle's center of gravity is about 28" from the ground. Positioning the lower reinforcing cables 22A, 22C below this level and the upper reinforcing cables 22B, 22D closer to this level causes the lower cables and lower portion of a vehicle to absorb much of the impact energy of a side impact while the upper cables simultaneously absorb impact forces and keep the vehicle on the ground and upright. This redirects the vehicle away from the crash cushion and reduces the likelihood it will rollover.

Additionally, because the cables 22A, 22B, 22C, 22D pass through the cable guides 34A, 34B, 34C, 34D and are not clamped to or otherwise affixed to the cable guides, the cables 22 reinforce and help stabilize the supports 12 but do not inhibit controlled collapse of the supports 12 during frontal vehicle impacts. In contrast, some prior art crash cushions have cables that are clamped or otherwise fixedly secured below their supports, which inhibits controlled collapse of the supports and causes the supports to tip or lean over rather than collapse in a telescoping accordion fashion.

ADDITIONAL CONSIDERATIONS

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments but is not necessarily included. Thus, the current technology can include a variety of combinations and/or integrations of the embodiments described herein.

Although the present application sets forth a detailed description of numerous different embodiments, the legal scope of the description is defined by the words of the claims set forth at the end of this patent and equivalents. The detailed description is to be construed as exemplary only and does not describe every possible embodiment since describing every possible embodiment would be impractical. Numerous alternative embodiments may be implemented, using either current technology or technology developed after the filing date of this patent, which would still fall within the scope of the claims.

Throughout this specification, plural instances may implement components, operations, or structures described as a single instance. Although individual operations of one or more methods are illustrated and described as separate operations, one or more of the individual operations may be performed concurrently, and nothing requires that the operations be performed in the order illustrated. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein.

As used herein, the terms "comprises," "comprising," "includes," "including," "has," "having" or any other variation thereof, are intended to cover a nonexclusive inclusion. For example, a process, method, article, or apparatus that comprises a list of elements is not necessarily limited to only those elements but may include other elements not expressly listed or inherent to such process, method, article, or apparatus.

The patent claims at the end of this patent application are not intended to be construed under 35 U.S.C. § 112(f) unless traditional means-plus-function language is expressly recited, such as "means for" or "step for" language being explicitly recited in the claim(s).

Although the invention has been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

1. A crash cushion for absorbing energy when impacted by a vehicle, the crash cushion comprising:

a plurality of supports, each support including a ground engaging component for engaging a ground surface, a left side cable guide positioned above the ground surface, and a right side cable guide positioned above the ground surface; wherein each support further comprises at least one left hinge assembly and at least one right hinge assembly;

a plurality of energy absorbing modules disposed between the supports;

a plurality of side panels attached to the left and right hinge assemblies that interconnect the supports and envelop the energy absorbing modules;

a front anchor structure;

a rear anchor structure spaced from the front anchor structure, the energy absorbing modules and the supports being positioned between the front anchor structure and the rear anchor structure;

a left side cable affixed to the front anchor structure and the rear anchor structure and extending through the left side cable guides so that a portion of the left side cable is above the ground surface; and a right side cable affixed to the front anchor structure and the rear anchor structure and extending through the right side cable guides so that a portion of the right side cable is above the ground surface;

wherein a width between the left and right side cable guides of each support is the same; and wherein a width between the left and right hinge assemblies of successive supports increases in a direction from the front anchor structure to the rear anchor structure.

2. The crash cushion as set forth in claim 1, wherein the left side cable guide and the right side cable guide of each support are positioned 22" above the ground surface.

3. The crash cushion as set forth in claim 1, wherein the left side cable guide and the right side cable guide each comprises a hollow tubular member defining a horizontally extending passageway.

4. The crash cushion as set forth in claim 3, each horizontally extending passageway having an internal diameter greater than an external diameter of the left side cable and the right side cable.

5. The crash cushion as set forth in claim 4, wherein the left and right side cables each have an external diameter of ¾".

6. The crash cushion as set forth in claim 4, wherein the horizontally extending passageways each have an inside diameter of at least 1".

7. The crash cushion as set forth in claim 3, wherein the left and right side cables pass through the horizontally extending passageways but are not clamped or otherwise affixed to the left and right side cable guides.

8. The crash cushion as set forth in claim 1, wherein the plurality of side panels comprise left side side panels and right side side panels positioned on opposite sides of the plurality of supports, wherein the plurality of supports include— a first support proximate to the front anchor structure and including a first central frame and first hinge assemblies mounted to the first central frame at a first distance apart from one another on opposite sides of the first central frame, and a second support proximate to the rear anchor structure and including a second central frame and second hinge assemblies mounted to the second central frame at a second distance apart from one another on opposite sides of the second central frame, wherein the second distance is wider than the first distance so that a space between the left side side panels and the right side side panels widens from the first support to the second support.

9. The crash cushion as set forth in claim 1, wherein each of the plurality of supports includes— a central frame, and unitary hinge assemblies mounted to opposite sides of the central frame, the unitary hinge assemblies including outer surfaces facing the plurality of side panels with heights that are substantially equal to heights of the plurality of side panels.

10. A crash cushion for absorbing energy when impacted by a vehicle, the crash cushion comprising:

a plurality of supports, each support including a ground engaging component for engaging a ground surface, a lower left side cable guide positioned above the ground surface, an upper left side cable guide positioned above the ground surface, a lower right side cable guide positioned above the ground surface, and an upper right side cable guide positioned above the ground surface;

a plurality of energy absorbing modules disposed between and supported by the supports;

a plurality of side panels that interconnect the supports and envelop the energy absorbing modules, the side panels positioned in an overlapping orientation;

a front anchor structure;

a rear anchor structure spaced from the front anchor structure, the energy absorbing modules and the supports being positioned between the front anchor structure and the rear anchor structure;

a lower left side cable affixed to the front anchor structure and the rear anchor structure and extending through the lower left side cable guides in the supports so that a portion of the left side cable is above the ground surface;

a lower right side cable affixed to the front anchor structure and the rear anchor structure and extending through the lower right side cable guides in the supports so that a portion of the right side cable is above the ground surface;

an upper left side cable affixed to the front anchor structure and the rear anchor structure and extending through the upper left side cable guides in the supports so that a portion of the left side cable is above the ground surface; and an upper right side cable affixed to the front anchor structure and the rear anchor structure and extending through the upper right side cable guides in the supports so that a portion of the right side cable is above the ground surface, wherein the plurality of side panels comprise left side side panels and right side side panels positioned on opposite sides of the plurality of supports, wherein each of the plurality of supports include a central frame and unitary hinge assemblies mounted to opposite sides of the central frame, the unitary hinge assemblies including outer surfaces facing the plurality of side panels with heights that are substantially equal to heights of the plurality of side panels, wherein the plurality of supports include:

a first support proximate to the front anchor structure and having a first width defined by a distance between the outer surfaces of the unitary hinge assemblies of the first support, and a second support proximate to the rear anchor structure and having a second width defined by a distance between the outer surfaces of the unitary hinge assemblies of the second support, wherein the second width is wider than the first width;

wherein a width between the left and right side cable guides of each support is the same.

11. The crash cushion as set forth in claim 10, wherein the lower left side cable guide and the lower right side cable guide are positioned 12-13" above the ground surface.

12. The crash cushion as set forth in claim 10, wherein the upper left side cable guide and the upper right side cable guide are positioned 22" above the ground surface.

13. The crash cushion as set forth in claim 10, wherein the lower left side cable guide, the lower right side cable guide, the upper left side cable guide, and the upper right side cable guide each comprise a hollow tubular member defining a horizontally extending passageway.

14. The crash cushion as set forth in claim 13, each horizontally extending passageway having an internal diameter greater than an external diameter of the lower left side cable, the lower right side cable, the upper left side cable, and the upper right side cable.

15. The crash cushion as set forth in claim 14, wherein the lower and upper left side cables and the lower and upper right side cables each have an external diameter of ¾".

16. A crash cushion for absorbing energy when impacted by a vehicle, the crash cushion comprising:

a plurality of supports, each support including a central frame, a ground engaging component depending below the central frame for engaging a ground surface, a lower left side cable guide positioned above the ground surface, an upper left side cable guide positioned above the ground surface, a lower right side cable guide positioned above the ground surface, and an upper right side cable guide positioned above the ground surface, each cable guide comprising a hollow tubular member defining a horizontally extending tubular passageway wherein each support further comprises at least one left hinge assembly and at least one right hinge assembly;

a plurality of energy absorbing modules disposed between and supported by the supports;

a plurality of side panels attached to the left and right hinge assemblies that interconnect the supports and envelop the energy absorbing modules, the side panels positioned in an overlapping orientation;

a front anchor structure;

a rear anchor structure spaced from the front anchor structure, the energy absorbing modules and the supports being positioned between the front anchor structure and the rear anchor structure;

a lower left side cable affixed to the front anchor structure and the rear anchor structure and extending through the lower left side cable guides in the supports so that a portion of the left side cable is above the ground surface;

a lower right side cable affixed to the front anchor structure and the rear anchor structure and extending through the lower right side cable guides in the supports so that a portion of the right side cable is above the ground surface;

an upper left side cable affixed to the front anchor structure and the rear anchor structure and extending through the upper left side cable guides in the supports so that a portion of the left side cable is above the ground surface;

an upper right side cable affixed to the front anchor structure and the rear anchor structure and extending through the upper right side cable guides in the supports so that a portion of the right side cable is above the ground surface;

wherein a width between the left and right side cable guides of each support is the same; and wherein a width between the left and right hinge assemblies of successive supports increases in a direction from the front anchor structure to the rear anchor structure; and wherein the lower and upper left side cables and the lower and upper right side cables pass through the horizontally extending passageways but are not clamped to or otherwise.

17. The crash cushion as set forth in claim 16, wherein the lower left side cable guide and the lower right side cable guide are positioned 12-13" above the ground surface.

18. The crash cushion as set forth in claim 16, wherein the upper left side cable guide and the upper right side cable guide are positioned 22" above the ground engaging component.

19. The crash cushion as set forth in claim 16, each horizontally extending passageway having an internal diameter greater than an external diameter of the lower left side cable, the lower right side cable, the upper left side cable, and the upper right side cable.

20. The crash cushion as set forth in claim 16, wherein the horizontally extending passageways each have an inside diameter of at least 1".

* * * * *